United States Patent [19]

Pieczykolan

[11] Patent Number: 4,619,327

[45] Date of Patent: Oct. 28, 1986

[54] SPRINKLER HEAD

[75] Inventor: George S. Pieczykolan, North Wales, Pa.

[73] Assignee: Central Sprinkler Corp., Lansdale, Pa.

[21] Appl. No.: 689,214

[22] Filed: Jan. 7, 1985

[51] Int. Cl.[4] ..... A62C 37/14

[52] U.S. Cl. ..... 169/38

[58] Field of Search ..... 169/37, 38, 39, 40, 169/41, 90

[56] References Cited

U.S. PATENT DOCUMENTS

| | | | |
|---|---|---|---|
| 2,528,063 | 10/1950 | Loepsinger | 169/38 |
| 3,080,000 | 3/1963 | Gloeckler | 169/41 |
| 4,217,961 | 8/1980 | Wotton | 169/41 |
| 4,491,182 | 1/1985 | Pieczykolan | 169/38 |
| 4,508,175 | 4/1985 | Pieczykolan | 169/38 |

FOREIGN PATENT DOCUMENTS

| | | | |
|---|---|---|---|
| 1322179 | 7/1973 | United Kingdom | 169/38 |

*Primary Examiner*—Jeffrey V. Nase

*Attorney, Agent, or Firm*—Seidel, Gonda, Goldhammer & Abbott

[57] ABSTRACT

A sprinkler head has a valve member retained in a closed position by a latch. The latch is released by a temperature responsive controller in the form of a bulb of frangible material and containing a heat expansible fluid. Compressive loads on the bulb are reduced whereby the bulb may be smaller and thinner than prior bulbs.

2 Claims, 5 Drawing Figures

SPRINKLER HEAD

BACKGROUND OF THE INVENTION

It is known to provide a sprinkler having a valve member retained in a closed position by a latch means. It is known to provide a temperature responsive means for releasing such a latch means. It is desirable to use a bulb of glass or other frangible material and containing a temperature responsive fluid as the temperature responsive means. In order for such a bulb to be sensitive, it should be small and have very thin walls. Since the bulb is used as a latch retainer, the fluid system pressure is so high so as to preclude use of bulbs which are small and thin-walled.

The present invention is directed to a solution of the problem of how to reduce compressive forces on the bulb whereby the bulb may be smaller and thinner than prior art bulbs.

SUMMARY OF THE INVENTION

The present invention is directed to a sprinkler for discharging a fire-quenching fluid when the surrounding environment is subjected to a pre-determined temperature. The sprinkler includes a body having a flow passage. A valve member is provided for controlling flow through said passage. A latch means is provided for retaining the valve member in a closed position. A temperature responsive means is provided for releasing the latch means. The temperature responsive means includes a bulb of frangible material and containing a heat expansible fluid. The latch means includes means for reducing compressive loads on the bulb whereby the bulb may be smaller and thinner than prior bulbs.

It is an object of the present invention to provide a glass bulb sprinkler wherein compressive loads acting against the glass bulb are drastically reduced whereby the sensitivity may be increased by reducing the wall thickness of the bulb and by making the bulb smaller.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
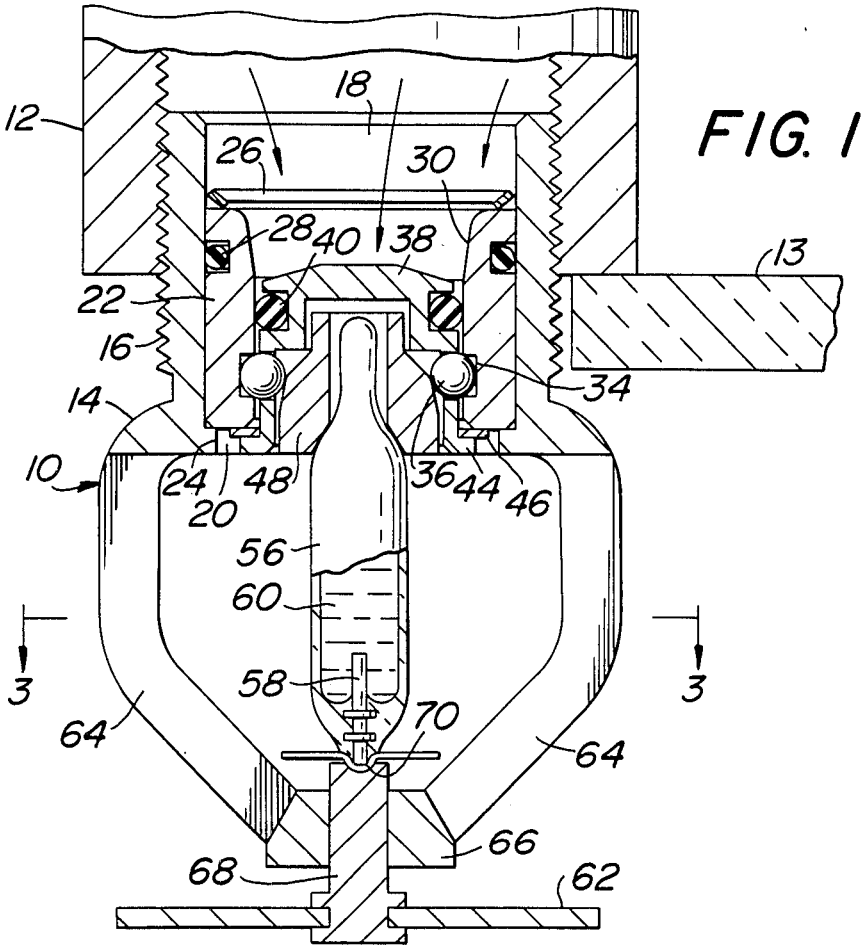
FIG. 1 is a sectional view through a sprinkler in accordance with the present invention and showing the sprinkler in a closed position.
Figure 3:
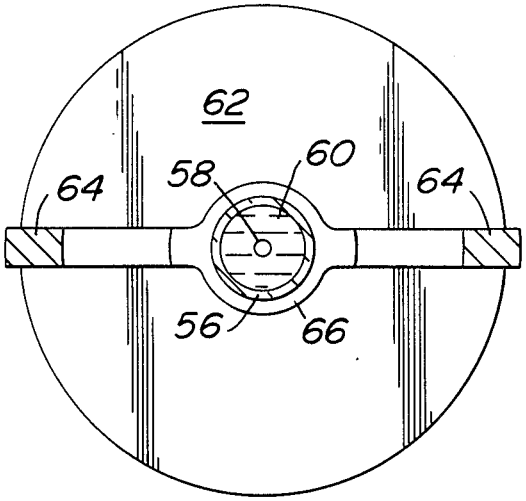
FIG. 3 is a sectional view taken along the line 3—3 in FIG. 1.

Referring to the drawing in detail, wherein like numerals indicate like elements, there is shown in FIG. 1 a sprinkler in accordance with the present invention designated generally as 10 and connected to one end of a supply pipe 12 disposed behind a wall or ceiling 13. The sprinkler includes a body 14 having threads 16 on a cylindrical portion at one end thereof. Threads 16 are meshed with threads on the inner surface of the supply pipe 12.

The body 14 has an inlet 18 and an outlet 20 which are co-axial. Between the inlet 18 and outlet 20, there is provided a cylindrical sleeve 22. The lower end of sleeve 22 rests on shoulder 24. Sleeve 22 is maintained in contact with shoulder 24 by a retaining ring 26 of the friction type. An O-ring seal 28 is provided between the outer periphery of the sleeve 22 and the inner periphery of the body 14.

The inlet end of the sleeve 22 includes a tapered surface 30 which merges into an axial surface 32. See FIG. 2. A groove 34 is provided in the surface 32. Groove 34 receives a portion of each of a plurality of balls 36. The balls 36 are also partially disposed within holes 42 on a housing 38. The housing 38 has a peripheral groove containing a resilient O-ring seal 40. Housing 38 is exposed to upstream pressure at the inlet 18. The seal 40 cushions pressure surges on the housing 38.

Figure 2:
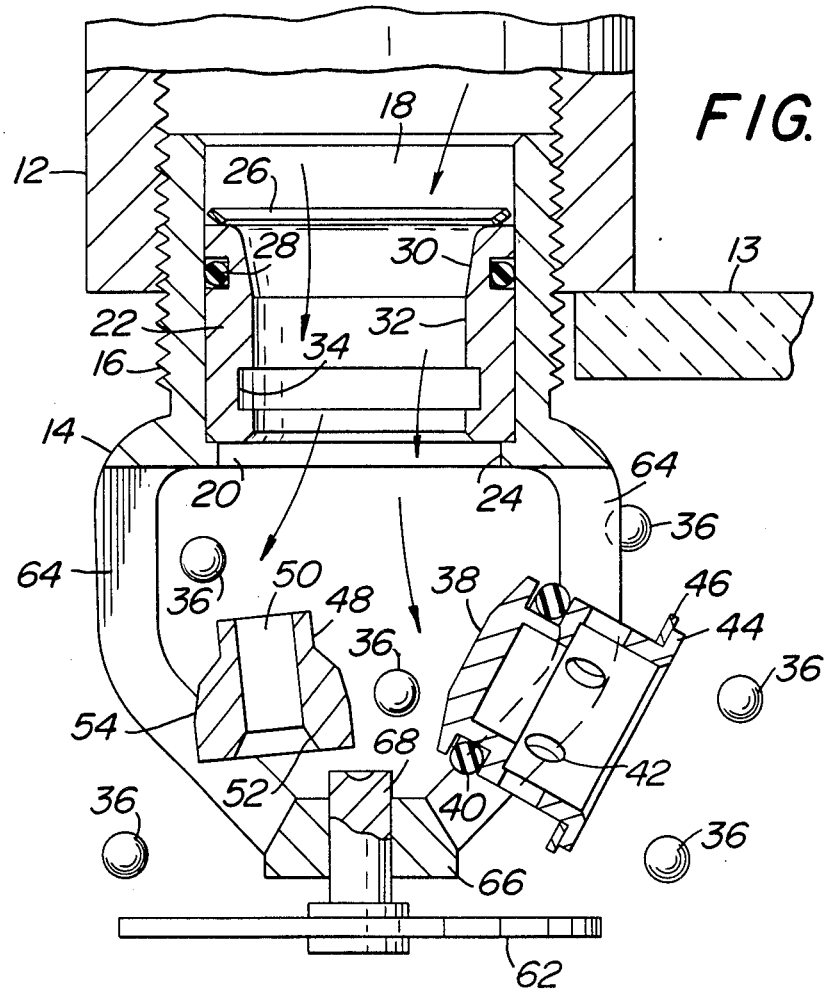
FIG. 2 is a view similar to FIG. 1 but showing the sprinkler in an open position.

The lower end of the housing 38 has a radially outwardly extending flange 44. A wave spring 46 is provided between flange 44 and the bottom surface on the sleeve 22. The spring 46 constitutes a means biasing the housing 38 from the closed position as shown in FIG. 1 to an open position as shown in FIG. 2. Thus, housing 38 with its seal 40 constitutes a valve member which is retained in the closed position by the balls 36. A temperature responsive means is provided for releasing the balls and includes a plunger 48. The plunger 48 has an axial passage 50 extending therethrough. One end of passage 50 is tapered or beveled as indicated at surface 52. The plunger 48 has a tapered surface 54 on its outer periphery for contact with the balls 36 so as to urge the balls into groove 34. The angle of the tapered surface 54 with respect to the axis of passage 50 is preferably less than approximately 15°.

Figure 4:
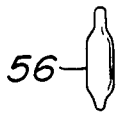
FIG. 4 is an elevation view of a bulb in accordance with the present invention.
Figure 5:
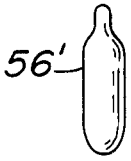
FIG. 5 PRIOR ART
FIG. 5 is a elevation view of a prior art bulb.

The passage 50 on the plunger 48 receives one end portion of a bulb 56 with surface 52 contacting a curved portion of the bulb 56. In FIG. 4 there is shown a comparison of the relative sizes of bulb 56 utilized herein and a prior art bulb designated 56'. Bulb 56' has a diameter of about 0.32 inches and a length of about 1 inch. Bulb 56 has a diameter of about 0.187 inches and a length of about 0.625 inches. The ability to use smaller and thinner walled bulbs results from the construction of the plunger 48 which reduces compressive loads applied by the system pressure by a ratio of approximately 6 to 1.

The bulb 56 cooperates with the plunger 48 to urge balls 36 into groove 34 and thereby retain the housing 38 in the closed position as shown in FIG. 1. Within the bulb 56 there is provided a heat expansible fluid 60 in contact with a heat sink 58 extending through the bulb 56 at ends remote from the plunger 48. A deflector 62 is supported from the body 14 by struts 64. The struts 64 are diametrically opposite one another and are integral at their lower end with the hub 66. Deflector 62 is connected to the hub 66 by the pin 68 which is forcefit into a hole in the hub 66 and which contacts the exposed heat conductor 70. Conductor 70 is external to the bulb 56 and connected to the heat sink 58. Conductor 70 is disposed within a concave groove on the upper end of pin 68.

FIG. 1 shows the components of the sprinkler 10 in a dormant condition. FIG. 2 shows the components of the sprinkler 10 in an activated position. When the fluid 60 expands sufficiently to fracture its glass housing, the plunger 48 drops away and no longer restrains inward movement of the balls 36. The balls 36 move inwardly through the holes 42, and the housing 38 moves downwardly under the combined effect of the system (fluid)

pressure and the spring 46. Thereafter, the fire-quenching fluid discharges from the outlet 20 onto the deflector 62.

The present invention may be embodied in other specific forms without departing from the spirit or essential attributes thereof and, accordingly, reference should be made to the appended claims, rather than to the foregoing specification, as indicating the scope of the invention.

I claim:

1. A sprinkler for discharging a fire quenching fluid, comprising a body having a sleeve portion and a flow passage therethrough, a valve member for controlling flow through said passage, said valve member having a plurality of openings facing a groove in said sleeve portion, a plurality of balls at least partially disposed in said openings and in contact with said groove, a bulb of frangible material and containing a heat expansible fluid, a plunger seated on said bulb and disposed so as to urge a portion of each of said balls into said sleeve groove to retain said valve member in a closed position, resilient seal means disposed between a surface of said sleeve portion and said plunger housing and spring means interposed between said sleeve means and said valve member urging it into open position.

2. A sprinkler in accordance with claim 1 wherein said plunger is hollow at least in part and is provided with a tapered surface on its inner periphery and in contact with said bulb, and wherein a portion of the outer periphery of said plunger is tapered and in contact with said balls.

* * * * *